US005861804A

United States Patent [19]

Fansa et al.

[11] Patent Number: 5,861,804

[45] Date of Patent: Jan. 19, 1999

[54] COMPUTER CONTROLLED SECURITY AND SURVEILLANCE SYSTEM

[75] Inventors: Kamal S Fansa; Darren P Surch, both of Costa Mesa; M. Khaled Aboudan, Lake Forest, all of Calif.

[73] Assignee: Bakson, Inc., Huntington Beach, Calif.

[21] Appl. No.: 891,180

[22] Filed: Jul. 10, 1997

[51] Int. Cl.[6] ..... G08B 1/08

[52] U.S. Cl. ..... 340/539; 340/506; 340/531; 340/825.69; 340/825.72; 395/892

[58] Field of Search ..... 340/506, 577, 340/518, 539, 541, 573, 574, 825.69, 825.72; 395/882, 892, 84

[56] References Cited

U.S. PATENT DOCUMENTS 4,772,876 9/1988 Laud ..... 340/539
5,381,136 1/1995 Powers et al. ..... 340/539
5,572,192 11/1996 Berube ..... 340/574
5,717,378 2/1998 Malvaso et al. ..... 340/506

*Primary Examiner*—Edward Lefkowitz
*Assistant Examiner*—Daryl C. Pope
*Attorney, Agent, or Firm*—James G. O'Neill

[57] ABSTRACT

The present invention provides a complete, easy to use and install security and surveillance system for a personal computer, which is designed to act as a peripheral to the personal computer. The system utilizes a radio frequency device having receiving and transmitting means connected between the serial port of the personal computer and various sensors to input signals to the non-data pins of the serial port whereby software in the personal computer interprets the signals received at the non-data pins to place a call to a pager or cellular phone, or communicate with another computer, produce sound effects, and/or operate video equipment.

18 Claims, 4 Drawing Sheets

30

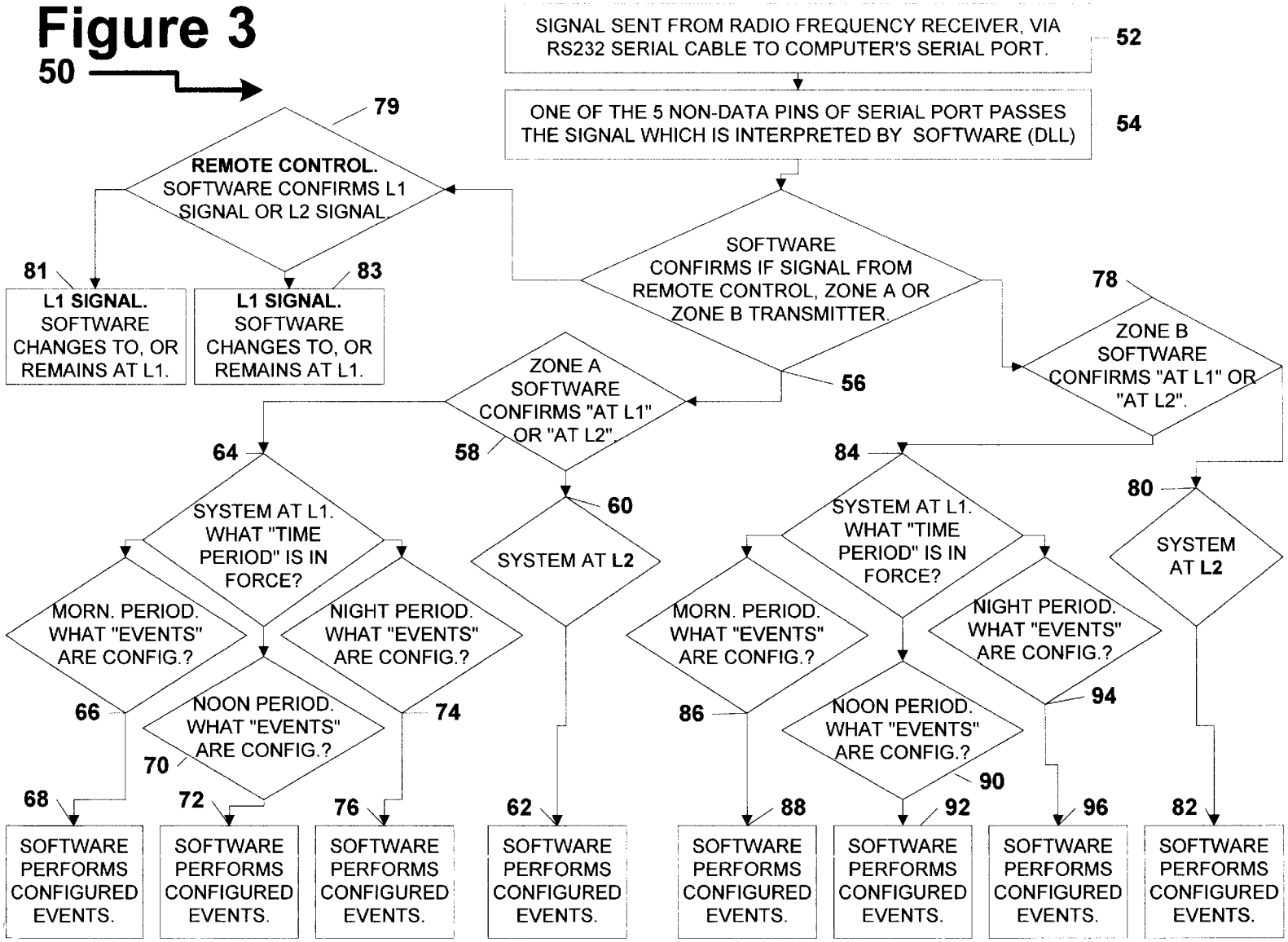
Figure 3
50
SIGNAL SENT FROM RADIO FREQUENCY RECEIVER, VIA RS232 SERIAL CABLE TO COMPUTER'S SERIAL PORT.
52
ONE OF THE 5 NON-DATA PINS OF SERIAL PORT PASSES THE SIGNAL WHICH IS INTERPRETED BY SOFTWARE (DLL)
54
SOFTWARE CONFIRMS IF SIGNAL FROM REMOTE CONTROL, ZONE A OR ZONE B TRANSMITTER.
56
ZONE B SOFTWARE CONFIRMS "AT L1" OR "AT L2".
78
ZONE A SOFTWARE CONFIRMS "AT L1" OR "AT L2".
58
REMOTE CONTROL. SOFTWARE CONFIRMS L1 SIGNAL OR L2 SIGNAL.
79
L1 SIGNAL. SOFTWARE CHANGES TO, OR REMAINS AT L1.
81
L1 SIGNAL. SOFTWARE CHANGES TO, OR REMAINS AT L1.
83
SYSTEM AT L2
60
SYSTEM AT L2
80
SYSTEM AT L1. WHAT "TIME PERIOD" IS IN FORCE?
64
SYSTEM AT L1. WHAT "TIME PERIOD" IS IN FORCE?
84
NIGHT PERIOD. WHAT "EVENTS" ARE CONFIG.?
74
NIGHT PERIOD. WHAT "EVENTS" ARE CONFIG.?
94
NOON PERIOD. WHAT "EVENTS" ARE CONFIG.?
70
NOON PERIOD. WHAT "EVENTS" ARE CONFIG.?
90
MORN. PERIOD. WHAT "EVENTS" ARE CONFIG.?
66
MORN. PERIOD. WHAT "EVENTS" ARE CONFIG.?
86
SOFTWARE PERFORMS CONFIGURED EVENTS.
62
SOFTWARE PERFORMS CONFIGURED EVENTS.
68
SOFTWARE PERFORMS CONFIGURED EVENTS.
72
SOFTWARE PERFORMS CONFIGURED EVENTS.
76
SOFTWARE PERFORMS CONFIGURED EVENTS.
88
SOFTWARE PERFORMS CONFIGURED EVENTS.
92
SOFTWARE PERFORMS CONFIGURED EVENTS.
96
SOFTWARE PERFORMS CONFIGURED EVENTS.
82

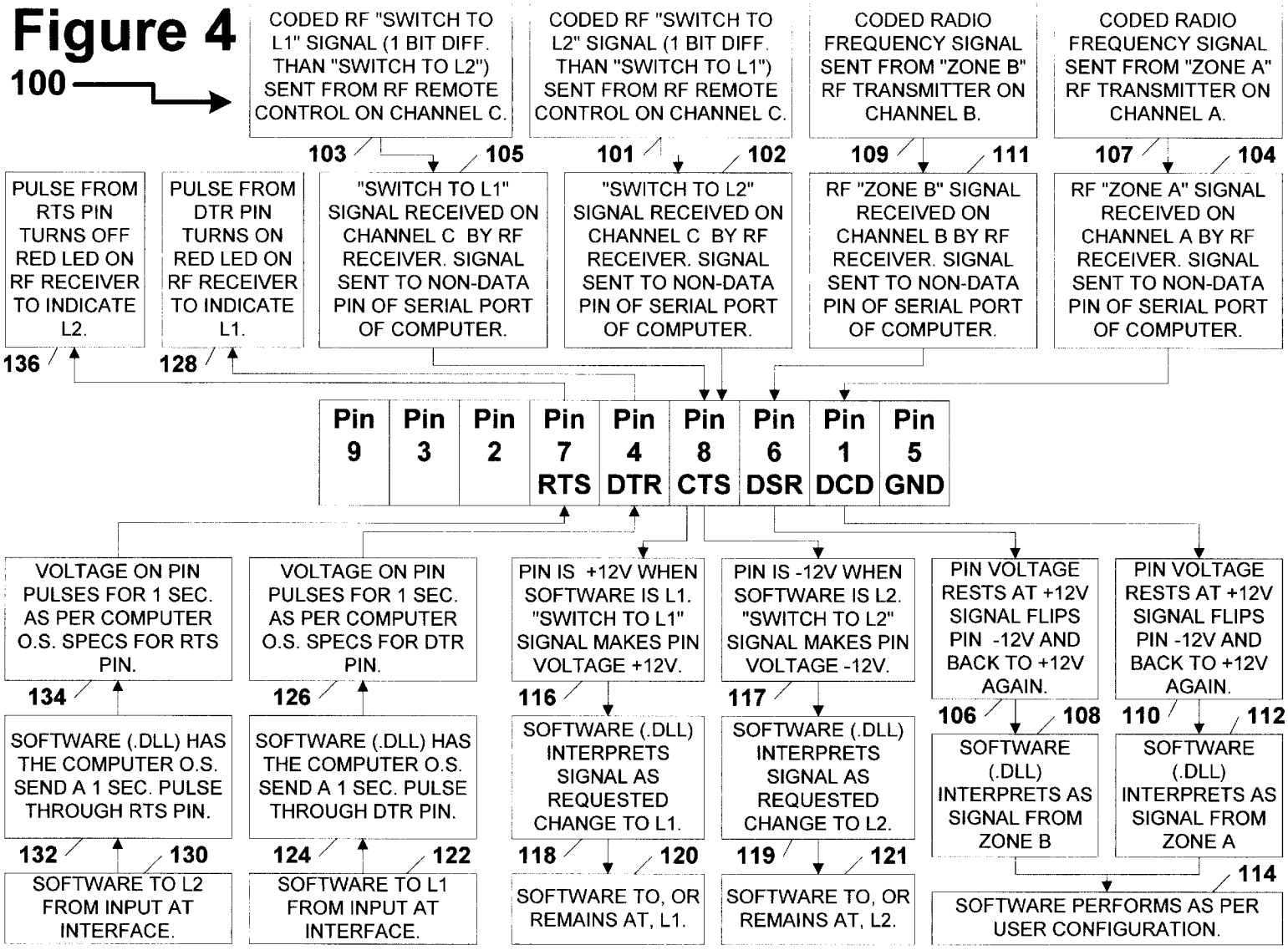
Figure 4
100
CODED RF "SWITCH TO L1" SIGNAL (1 BIT DIFF. THAN "SWITCH TO L2") SENT FROM RF REMOTE CONTROL ON CHANNEL C.
103
"SWITCH TO L1" SIGNAL RECEIVED ON CHANNEL C BY RF RECEIVER. SIGNAL SENT TO NON-DATA PIN OF SERIAL PORT OF COMPUTER.
105
PULSE FROM DTR PIN TURNS ON RED LED ON RF RECEIVER TO INDICATE L1.
128
PULSE FROM RTS PIN TURNS OFF RED LED ON RF RECEIVER TO INDICATE L2.
136
CODED RF "SWITCH TO L2" SIGNAL (1 BIT DIFF. THAN "SWITCH TO L1") SENT FROM RF REMOTE CONTROL ON CHANNEL C.
101
"SWITCH TO L2" SIGNAL RECEIVED ON CHANNEL C BY RF RECEIVER. SIGNAL SENT TO NON-DATA PIN OF SERIAL PORT OF COMPUTER.
102
CODED RADIO FREQUENCY SIGNAL SENT FROM "ZONE B" RF TRANSMITTER ON CHANNEL B.
109
RF "ZONE B" SIGNAL RECEIVED ON CHANNEL B BY RF RECEIVER. SIGNAL SENT TO NON-DATA PIN OF SERIAL PORT OF COMPUTER.
111
CODED RADIO FREQUENCY SIGNAL SENT FROM "ZONE A" RF TRANSMITTER ON CHANNEL A.
107
RF "ZONE A" SIGNAL RECEIVED ON CHANNEL A BY RF RECEIVER. SIGNAL SENT TO NON-DATA PIN OF SERIAL PORT OF COMPUTER.
104
Pin 9
Pin 3
Pin 2
Pin 7 RTS
Pin 4 DTR
Pin 8 CTS
Pin 6 DSR
Pin 1 DCD
Pin 5 GND
VOLTAGE ON PIN PULSES FOR 1 SEC. AS PER COMPUTER O.S. SPECS FOR RTS PIN.
134
SOFTWARE (.DLL) HAS THE COMPUTER O.S. SEND A 1 SEC. PULSE THROUGH RTS PIN.
132
SOFTWARE TO L2 FROM INPUT AT INTERFACE.
130
VOLTAGE ON PIN PULSES FOR 1 SEC. AS PER COMPUTER O.S. SPECS FOR DTR PIN.
126
SOFTWARE (.DLL) HAS THE COMPUTER O.S. SEND A 1 SEC. PULSE THROUGH DTR PIN.
124
SOFTWARE TO L1 FROM INPUT AT INTERFACE.
122
PIN IS +12V WHEN SOFTWARE IS L1. "SWITCH TO L1" SIGNAL MAKES PIN VOLTAGE +12V.
116
SOFTWARE (.DLL) INTERPRETS SIGNAL AS REQUESTED CHANGE TO L1.
118
SOFTWARE TO, OR REMAINS AT, L1.
120
PIN IS -12V WHEN SOFTWARE IS L2. "SWITCH TO L2" SIGNAL MAKES PIN VOLTAGE -12V.
117
SOFTWARE (.DLL) INTERPRETS SIGNAL AS REQUESTED CHANGE TO L2.
119
SOFTWARE TO, OR REMAINS AT, L2.
121
PIN VOLTAGE RESTS AT +12V SIGNAL FLIPS PIN -12V AND BACK TO +12V AGAIN.
106
SOFTWARE (.DLL) INTERPRETS AS SIGNAL FROM ZONE B
108
PIN VOLTAGE RESTS AT +12V SIGNAL FLIPS PIN -12V AND BACK TO +12V AGAIN.
110
SOFTWARE (.DLL) INTERPRETS AS SIGNAL FROM ZONE A
112
SOFTWARE PERFORMS AS PER USER CONFIGURATION.
114

COMPUTER CONTROLLED SECURITY AND SURVEILLANCE SYSTEM

BACKGROUND OF THE INVENTION

1. Field of the Invention

This invention relates generally to security systems, and more particularly, to an improved and simplified process and device for use with a personal computer to provide security and surveillance capabilities.

2. Description of the Related Art

Burglaries and vandalism of homes and offices is a widespread problem. To protect against such occurrences, many types of security systems are known to safeguard persons and property. These systems tend to be expensive and complex, and/or hard to install and use. Such systems include those that are built into or added to a home or vehicle, or those which are separate, but tied into a central monitoring station. Other systems such as that disclosed in U.S. Pat. No. 4,006,460 to Hewit et al, utilize a bi-directional interface for coupling remote security transducers and monitoring devices to a computer, such that the circuitry of the bi-directional electronic interface has multiple functions, including the scanning of data in the signals from the bi-directional interface by the computer. This device tends to be expensive to implement and use, and does not provide surveillance capabilities.

Other problems exist with known security and surveillance systems, such as the need for specialized equipment and/or personnel to adequately install and use them. Additionally, although various solutions have been proposed to overcome the shortcomings of known security and surveillance systems, these solutions still tend to be expensive and hard to implement. One solution is to provide a central monitoring station with coded information, such as shown in U.S. Pat. No. 4,511,886 to Rodriguez. However, a disadvantage of this system is that it is complicated to use and expensive to acquire. A further disadvantage of this system is that it is not designed to automatically record events, or advise an owner of a security problem.

Additionally, when security and surveillance systems are used, long term (2 or 3 year) monitoring contracts present a further problem. These systems rely on a monitoring company to monitor the systems and to contact the police if the system is triggered. This results in delays, and raises another big problem, that of false alarms. False alarms are such a drain on police resources that many states have enacted laws regarding them. Stiff fines apply for each false alarm, and in many states police will cease to respond if a user has over a certain number of false Alarms in a given period.

Finally, the known devices are not easily controlled by the user, other than by working with a central monitoring station, or shutting the system off entirely, thereby defeating the purpose of having the system.

There, therefore, still exist a need for a system which is easily and quickly connected to available or emerging personal computer systems, to add security and surveillance capabilities to the personal computer system. The security system of the present invention is connected to the serial port of a personal computer system, but does not use the data pins therein.

The present invention provides a security system which together with unique software installed in the personal computer being used, includes selected point-of entry sensors and motion detector devices which transmit signals to a radio frequency receiver connected to the serial port of the personal computer. The novel radio frequency device transmits no data through the data pins of the serial port to the software, but instead send a simple signal to the non data pins to operate the system through the unique software. This provides for simplicity in operation, while substantially reducing the cost of the equipment and increasing its reliability.

SUMMARY OF THE INVENTION

It is, therefore, an object of the present invention to provide an improved security and surveillance system. It is another object of the present invention to provide a means for connecting a security and surveillance system to a personal computer. It is a further object of the present invention to provide a facile method that enables an owner of a specific personal computer to easily add a security and surveillance system to the personal computer. It is still another object of the present invention to provide a security and surveillance system which includes a radio frequency device that is linked to a personal computer through the serial port of the personal computer in such a manner that only the non data pins of the serial port are used. It is yet a still further object of the present invention to provide a method and apparatus for selectively using the non data pins of a serial port of a personal computer to provide a security and surveillance system for the personal computer and adjacent areas.

In accordance with the present invention there is provided a complete, easy to use and install security and surveillance system for a personal computer, which is designed to act as a peripheral to the personal computer. The present invention includes the steps of connecting a wireless radio frequency device between the serial port of the personal computer and various sensors, and includes means for operating the security and surveillance system by the personal computer.

BRIEF DESCRIPTION OF THE DRAWINGS

The objects and features of the present invention, which are believed to be novel, are set forth with particularity in the appended claims. The present invention, both as to its organization and manner of operation, together with further objects and advantages, may best be understood by reference to the following description, taken in connection with the accompanying drawings, in which:

FIG. 3 is a flow chart depicting further details of the process of operation of the security and surveillance system shown in FIG. 2; and FIG. 4 is a flow chart depicting details of the connection and operation of the security and surveillance system of the present invention through the serial port of a personal computer.

DESCRIPTION OF THE PREFERRED EMBODIMENTS

The following description is provided to enable any person skilled in the art to make and use the invention and sets forth the best modes contemplated by the inventors of carrying out their invention. Various modifications, however, will remain readily apparent to those skilled in the art, since the generic principles of the present invention have been defined herein specifically to provide for an improved and simplified process and system for connection to a personal computer system ("PC"), to enable a user to add security and surveillance capabilities to the PC, and surrounding areas within range of the added system.

By way of example, and not by way of limitation, set forth below is a description of a preferred embodiment of an apparatus and process of the present invention which is connected to the serial port of a PC, and which PC has proprietary software installed therein to operate the security and surveillance system to thwart criminal intent, and to provide safety and surveillance.

Figure 1:
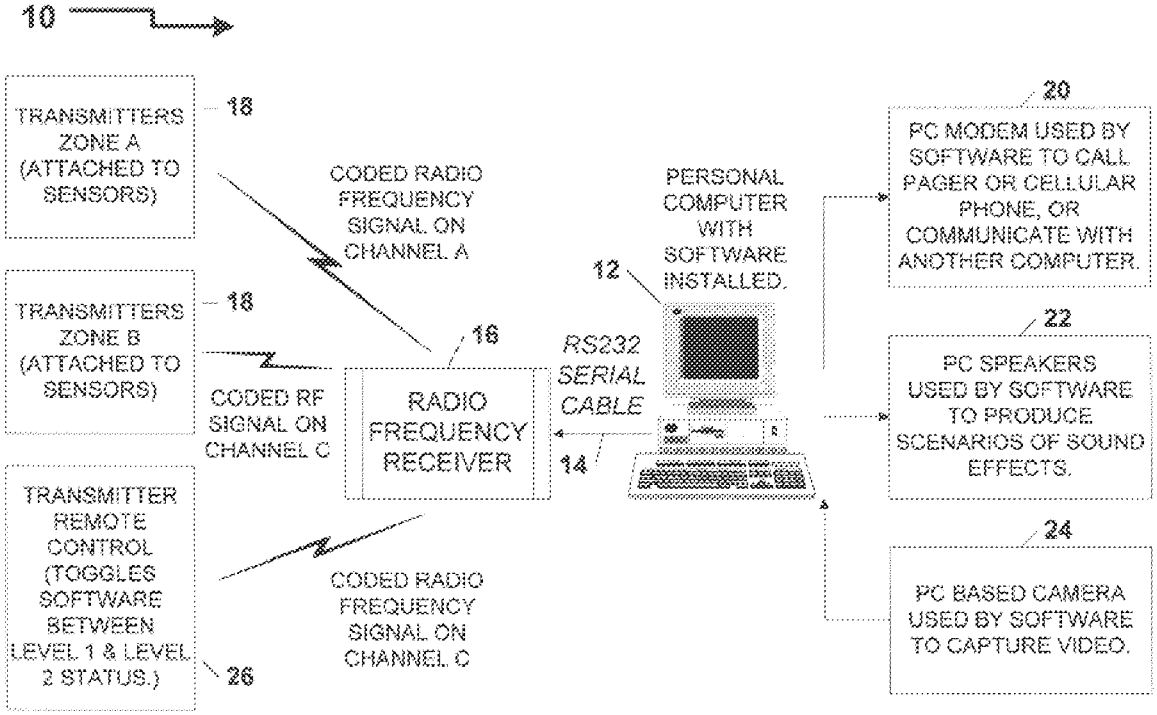
FIG. 1 is a schematic representation of a preferred embodiment of the security and surveillance system of the present invention connected to a personal computer.

Turning now to the drawings, and, in particular, FIG. 1, a preferred embodiment of the simplified system of the present invention is illustrated at 10. The system 10 includes a PC 12 having an unused serial port of known configuration therein. An RS 232 serial cable 14 is coupled between the serial port of the PC and a specifically designed wireless radio frequency receiver 16. The wireless radio frequency receiver 16 receives radio frequency signals from a plurality of transmitters 18 attached to sensors in a pair of protected areas Zone A and Zone B, as described more fully below. The system may also include a remote control unit 26, to toggle the proprietary software in the PC between different levels, as described more fully below. Additionally, the sensors connected to the transmitters 18 in the separate Zones A and B, may be of any desired type, such as point-of-entry sensors, motion detectors, and the like, which emit a radio frequency signal picked up by the receiver if an unauthorized incursion or other event occurs in a zone protected/scanned by the system. For example, the system may be used to warn a user and let the user view children in a video window on the screen of the PC when the children enter danger or an off limit area of the home or grounds, such as a pool area; or to monitor what staff, baby sitters, or maids have been up to when the user is away, and allow the system to perform specifically programmed action or actions, as described below.

The proprietary software installed in the PC 12 senses and interprets signals from the receiver 16 through the non-data pins of the serial port, as described more fully below, and operates various components of the PC as part of the security and surveillance system. For example, a modem in the PC could be used to call a specific pager or cellular phone 20, speakers 22 in the PC could be activated to produce different programmed sound effects, and/or a plurality of video cameras 24 could be activated by the PC to record images.

It should be noted that the wireless radio frequency receiver 16 is a three channel receiver having a limited RF range. For example, in one embodiment, this limit is 130 feet (can vary, depending on the size and other variables in the receiver). Zones A and B are two separately defined areas within RF range of the receiver, wherein the sensor/transmitter devices 18 will be placed. For example, Zones A and B can be separate rooms in a home or suite of offices, separate sections in a large room, or different floors in a commercial building, home, or suite of offices.

Figure 2:
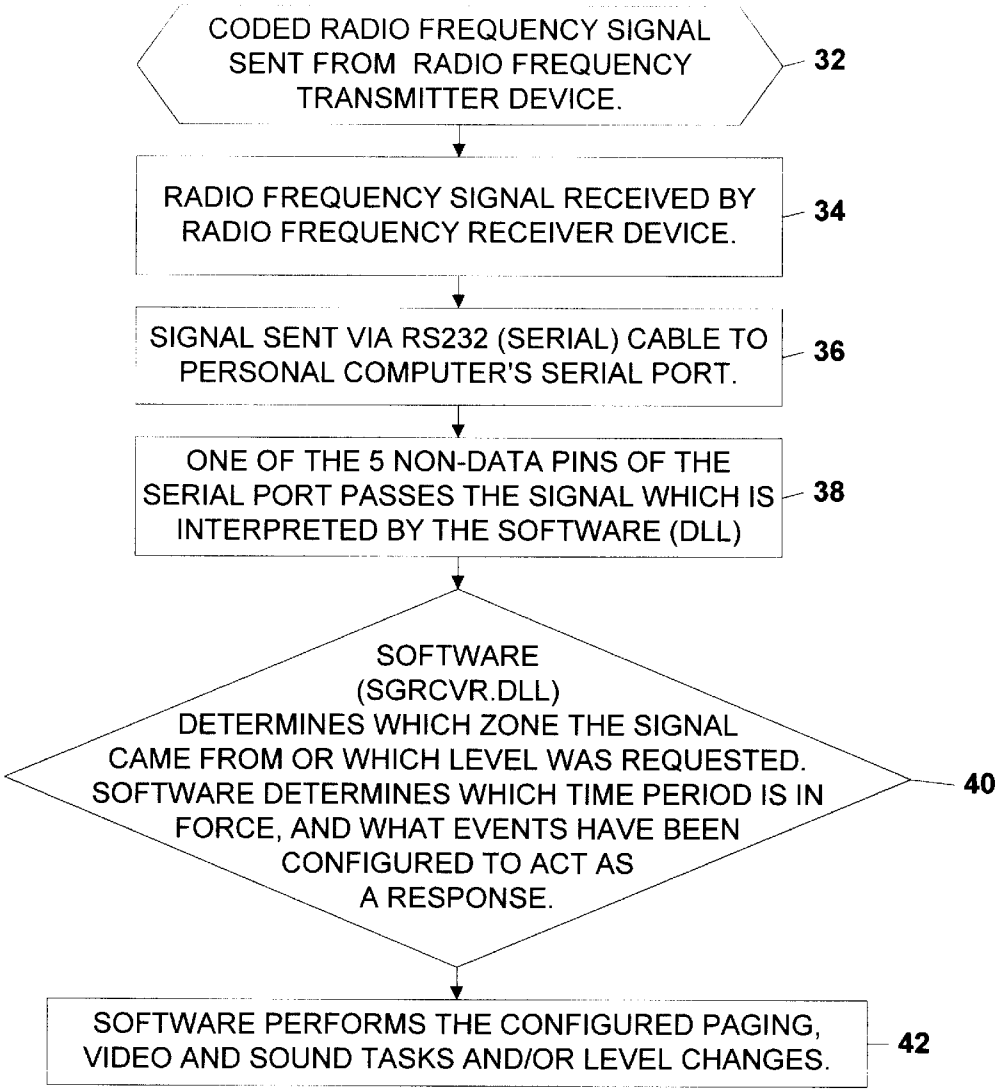
FIG. 2 is a flow chart depicting a process of operation of the security and surveillance system of the present invention when connected to the personal computer of FIG. 1.

Turning now to FIG. 2, there shown is a flow chart 30 of a process of operation of the present invention 10. Once the software has been installed and activated on the PC, the receiver 16 installed and activated, and the sensors installed in Zones A and B and activated, the security and surveillance system of the present invention will be ready for operation. If an intruder enters Zone A or B, or any other proscribed action takes place, a coded radio frequency signal 32, will be sent by one or more of the sensor transmitters to the radio frequency receiver 34. The radio frequency receiver may be formed in any desired manner, but is preferably a unique device designed receive coded radio signals and to emit electrical signals based on the received signal which travels via the RS232 serial cable 36 to the serial port of the PC where it effects one or more of the non-data pins 38. The behavior of these non-data pins 38 are then interpreted by the installed software. As shown in box 40, the software then determines which zone the incoming signal came from, which level the system is currently adjusted to, the time period which is currently in force, and what "events" have been configured to act, or take place, as a response to the received signal. As shown at 42, the software then performs the configured events, such as calling or paging a designated number, sounding a predesignated sound or series of sounds, and operating a video camera, if one is provided and connected to the PC.

FIG. 3 is a flow chart 50 showing in more detail what happens during the process of operation of the invention 10 after the signal is received by the receiver 16. The received radio frequency signal is sent by the receiver via the cable to the serial port 52, where one of the five non-data pins is effected by or senses the signal 54. As shown at 56, the behavior of the non-data pin of the serial port, or the sensing of the signal at such non-data pin, is interpreted by the software in the PC and this software determines if the signal is coming from a Zone A or Zone B transmitter, or the remote control unit. If Zone A, 58, the software confirms whether the system is set to Level 1 or Level 2. If the system is set to Level 2, 60, the software then performs the configured events 62, such as calling or paging a designated number, sounding a predesignated sound, and operating a video camera, if provided. Returning to decision box 56, if the system is set to Level 1, the time period currently in force must be determined 64. If a "morning period" is sensed 66, the software must determine what "events" have been configured to act, and then perform these events 68. Returning to decision box 64, if a "noon period" is sensed 70, the software must determine what "events" have been configured to act, and then perform these events 72.

Returning again to decision box 64, if a "night period" is sensed 74, the software must determine what "events" have been configured to act, and then perform these events 76.

Returning to decision box 56, if a Zone B signal is sensed 78, the software then goes through the same confirming process as for Zone A. That is, confirms whether the system is set to Level 1 or Level 2. If the system is set to Level 2, 80, the software then performs the configured events 82. If, however, the system is set to Level 1, 84, the time period currently in force must be determined. If a "morning period" is sensed 86, the software must determine what "events" have been configured to act, and then perform these events 88. If a "night period" is sensed 90, the software must determine what "events" have been configured to act, and then perform these events 92. Finally, if a "noon period" is sensed 94, the software must determine what "events" have been configured to act, and then perform these events 96.

Returning again to decision box 56, if a remote control signal is sensed 79, the software confirms whether the signal is a Level 1 or Level 2 signal. If a Level 1 signal is sensed 81, the software changes to, or remains at Level 1. If a Level 2 signal is sensed 83, the software changes to, or remains at Level 2.

Turning now to FIG. 4, a flow chart 100 shows in greater detail the operation of the non-data pins in the serial port of the PC. Pin 5, is, of course, ground and does not receive signals. However, the non-data pins 1, 4, 6, 7, and 8 are used to communicate with the receiver 16, via the serial cable. As shown at boxes 101 and 103, when the remote control is activated, the remote control will send a radio frequency signal to the receiver to either switch to the other Level, or remain at the current Level. For example, if presently at Level 1, as shown in box 101, and the coded radio frequency signal from the remote control is "Switch to Level 2", a 1 bit different signal from that of "Switch to Level 2", then this signal will be sent to the receiver 102, which will in turn send a signal to non-data pin 8 so that the software will toggle from Level 1 to Level 2.

Turning now to box 103, if the system is at Level 2, and the coded radio frequency signal from the remote control is "Switch to Level 2", a 1 bit different signal than "Switch to Level 1", then this signal is sent to the receiver 105, which then sends a signal to non-data pin 8 so that the software will toggle from Level 2 to Level 1.

As shown at boxes 107 and 109, if one of the sensors in Zone A or B detects something, a transmitter will send a coded radio frequency signal to the radio frequency receiver. If from Zone A, box 107, the receiver will receive a Zone A signal, box 104, and then send a signal to pin 1. If the signal received is from Zone B, box 109, the receiver will receive a Zone B signal, box 111, and then send a signal to pin 6.

If a signal is received at pin 6, since the voltage on the pin is +12V, the signal flips the voltage to −12V and back to +12V again, 106. The software interprets this as a signal from Zone B, 108. If a signal is received at pin 1, again since the voltage on the pin is +12V, the signal flips the voltage to −12V and back to +12V again, 110. The software interprets this as a signal from Zone A, 112. A signal received from either or both Zones A or B, will cause the software to perform events 114, according to a users programmed configuration.

As shown at box 116, if the voltage on pin 8 is +12V the software is at Level 1, while box 117 shows that if the voltage on pin 8 is −12V the software is at Level 2. A signal received at pin 8 changes the voltage perceived to the other, boxes 118 and 119, to thus change the Level from one to the other, boxes 120 and 121.

The radio frequency receiver 16 may include an indicating light or LED to indicate at what level the software is set. As shown in FIG. 4, if the software is at or changed to Level 1, 122, the software has the PC operating system send a one second pulse 124 to DTR pin 4, this will pulse the voltage on pin 4, 126, to thereby turn on a red LED 128, on receiver 16. Alternately, if the software is at or changed to Level 2, 130, the software has the PC operating system send a one second pulse 132 to RTS pin 7, this will pulse the voltage on pin 7, 134, to thereby turn off the red LED 136, on receiver 16.

Thus, there has been described an improved simplified method and device for providing a security and surveillance system for a PC. Since the disclosed system, device and process of using only uses the non-data pins of an existing serial port of a PC, the cost and complexity of this system and its operation are substantially reduced while robustness and simplicity of manufacture are increased.

Those skilled in the art will appreciate that various adaptations and modifications of the just-described preferred embodiments can be configured without departing from the scope and spirit of the invention. Therefore, it is to be understood that, within the scope of the appended claims, the invention may be practiced other than as specifically described herein.

What is claimed is:

1. A security and surveillance system operative with a personal computer system, said security and surveillance system comprising:

a housing having a wireless radio frequency connection to a plurality of remote sensing devices and a serial cable connected to a serial port of the personal computer system, the serial port having data and non-data pins;

receiving means for receiving radio frequency signals in the housing;

means for making a further signal from the radio frequency signals received in the housing and sending the further signal only to the non-data pins in the serial port so that no data signals are sent to the data pins; and means in the personal computer system interpreting the further signals received at the non-data pins in the serial port to operate various components of the personal computer to produce programmed responses.

2. The security and surveillance system of claim 1 wherein the plurality of remote sensing devices include radio frequency transmitting means.

3. The security and surveillance system of claim 2, further including remote control operating means for toggling the means in the personal computer system interpreting the further signals received at the non-data pins between first and second settings.

4. A radio frequency security and surveillance system operative with a personal computer system, the radio frequency security and surveillance system comprising:

a plurality of remote sensing devices having means for transmitting radio frequency signals therein;

means for receiving the transmitted radio frequency signals from the plurality of remote sensing devices and forming further signals in response thereto;

means for coupling said means for receiving the transmitted radio frequency signals to a serial port on personal computer system, the serial port having data pins and non-data pins;

means in the means for receiving the transmitted radio frequency signals to transmit the further signals only to the non-data pins; and means in the personal computer system interpreting the further signals received at the non-data pins to operate various components of said personal computer to produce programmed responses to received further signals.

5. The radio frequency security and surveillance system of claim 4, further including remote control operating means for toggling the means in the personal computer system interpreting the further signals received at the non-data pins between first and second settings.

6. A method of controlling a security and surveillance system comprising the steps of:

receiving coded radio frequency signals sent from at least one radio frequency transmitter device;

forming further electrical signals based on the received coded radio frequency signals;

sending the further electrical signals to non-data pins in a serial port of a personal computer;

interpreting the further electrical signals received at the non-data pins; and performing tasks in the personal computer based on the interpreted signals received at the non-data pins so as to operate various components of said personal computer to produce programmed responses to received further signals.

7. The method of claim 6, comprising the further step of sending the further electrical signals to specific non-data pins, depending on which of two preselected zones the coded radio frequency signal is received.

8. The method of claim 7, comprising the further step of remotely toggling the personal computer between different settings of tasks to perform.

9. The method of claim 8, comprising the further step of setting times in the personal computer whereby different tasks will be performed at different times.

10. The method of claim 6, comprising the further step of remotely changing the personal computer between different settings of tasks to perform.

11. The method of claim 6, comprising the further step of changing the voltage applied to the non-data pins to enable means in the personal computer to interpret what tasks to perform.

12. The method of claim 11, comprising the further step of changing the voltage on at least one non-data pin from +12V to −12V.

13. The method of claim 11, comprising the further step of changing the voltage on at least one non-data pin from −12V to +12V.

14. The method of claim 11, comprising the further step of changing the voltage on at least one non-data pin from +12V to −12V and back to +12V.

15. The method of claim 6, comprising the further step of changing the voltage applied to the non-data pins to enable means in the personal computer to interpret from which of the two separate zones the coded radio frequency signal was received.

16. The method of claim 15, comprising the further step of changing the voltage on at least one non-data pin from +12V to −12V.

17. The method of claim 15, comprising the further step of changing the voltage on at least one non-data pin from −12V to +12V.

18. The method of claim 15, comprising the further step of changing the voltage on at least one non-data pin from +12V to −12V and back to +12V.

* * * * *